United States Patent [19]

Haftmann

[11] 4,273,453

[45] Jun. 16, 1981

[54] SELECTIVELY ENGAGEABLE RIBBON RE-INKING DEVICE FOR INK RIBBON CARTRIDGE

[75] Inventor: Johannes Haftmann, Borchen-Doerenhagen, Fed. Rep. of Germany

[73] Assignee: Nixdorf Computer AG, Paderborn, Fed. Rep. of Germany

[21] Appl. No.: 53,140

[22] Filed: Jun. 28, 1979

[30] Foreign Application Priority Data

Jul. 12, 1978 [DE] Fed. Rep. of Germany ..... 2830657

[51] Int. Cl.[3] ..... B41J 33/10

[52] U.S. Cl. ..... 400/196.1; 400/195; 400/202.4; 400/207; 400/82; 400/234

[58] Field of Search ..... 400/82, 194, 195, 196, 400/196.1, 197, 202.4, 208, 207, 234

[56] References Cited

U.S. PATENT DOCUMENTS

| | | | |
|---|---|---|---|
| 2,724,489 | 11/1955 | Fields | 400/202.4 X |
| 2,969,865 | 1/1961 | Long | 400/202.4 X |
| 4,046,247 | 9/1977 | La Spesa et al. | 400/196 |
| 4,071,133 | 1/1978 | Scherrer et al. | 400/202.4 X |
| 4,091,913 | 5/1978 | Ku et al. | 400/196.1 X |
| 4,091,914 | 5/1978 | Stipanuk | 400/208 X |
| 4,213,715 | 7/1980 | Haftmann et al. | 400/196.1 |

FOREIGN PATENT DOCUMENTS

| | | | |
|---|---|---|---|
| 156810 | 5/1904 | Fed. Rep. of Germany | 400/194 |
| 2550305 | 5/1977 | Fed. Rep. of Germany | 400/202.4 |
| 2557803 | 6/1977 | Fed. Rep. of Germany | 400/196 |
| 2117494 | 9/1978 | Fed. Rep. of Germany | 400/202.4 |
| 2717076 | 10/1978 | Fed. Rep. of Germany | 400/196.1 |

*Primary Examiner*—Ernest T. Wright, Jr.
*Attorney, Agent, or Firm*—Krass, Young & Schivley

[57] ABSTRACT

An ink ribbon unit for printers in which the inking roller is selectively brought into engagement with the ribbon thereby to avoid over-inking.

3 Claims, 4 Drawing Figures

SELECTIVELY ENGAGEABLE RIBBON RE-INKING DEVICE FOR INK RIBBON CARTRIDGE

INTRODUCTION

This invention relates to an ink-ribbon unit for a printing mechanism with a storage chamber having an inlet and an outlet opening for an endless ink ribbon stored in loops lying against one another and with a ribbon guide device connected with the storage chamber for guiding the endless ink ribbon from the outlet opening through at least one printing region to the inlet opening, wherein the ribbon guide device contains an inking device for the ink ribbon arranged on the continuous path of the ink ribbon.

An ink-ribbon unit of this type is the subject of German Patent Application Ser. No. P 27 17 076.9-27. Conventional inking or impregnating devices in ink-ribbon units operate directly and automatically from and with the driving element assigned to conveying the ink ribbon. Using this technique, a new ink ribbon becomes supersaturated with ink. In printing a recording tape inevitably a larger amount of ink is given off then than is necessary for the printing. This necessitates not only earlier replacement of the ink ribbon, but also causes the printed characters on the recording tape to become smeared and thus difficult or impossible to read.

The invention is based on the problem of designing an ink ribbon unit of the type mentioned at the outset in such a way that the longest possible service lift of the ink ribbon with a good quality imprint is assured.

To solve this problem, it is proposed according to the invention that the inking device is brought into operation selectively.

By the solution according to the invention it is achieved that the ink ribbon first gives off a substantial part of the ink it contains before the inking device is set into operation and the ink used up is again replenished in the now somewhat depleted ink ribbon. In this way not only is achieved a sparing consumption of the ink and thus a long service life of the ink ribbon, but also a neat and always quite legible imprint.

Turning the inking device on and off can be achieved in a simple way by means of an ink-storage element which can be selectively brought into an ink-transferring contact with the ribbon. Preferably, the transfer of ink from the ink-storage element to the ink ribbon is not done directly, but rather by way of an inking roller with the ink ribbon winding around part of its periphery, which roller can be brought selectively into ink-transferring contact with the ink-storage element. This achieves a uniform application and a continuous distribution of the ink on the ink ribbon. Moreover, an ink-storage element designed to be interchangable makes is possible to replace the latter without the running of the ink ribbon being influenced thereby.

According to one simple and reliably operating embodiment it is proposed that the ink-storage element be formed by a feed roller which stores ink and is intended to roll on the inking roller, and that the two rollers be adjustable relative to one another as between a roller-engaging position and a noncontacting position. Preferably the inking roller here is mounted stationary, so that the running of the ink ribbon is not affected by the change in the relative position of the two rollers. The feed roller may be mounted on a rocker which can be swung between a position corresponding to the engaging position and one corresponding to the noncontacting position of the rollers, swung around an axis of rotation essentially parallel to the shafts of the rollers. This requires only a slight swinging of the feed roller in order to bring it into contact or out of contact with the inking roller.

In order to keep the adjusting mechanism as simple as possible, the feed roller is preferably pretensioned in the noncontacting position and is capable of being moved by an actuating element over into the engaging position, in which it can be locked. The pretensioning can be done by spring means or else, by a suitable design position of the ink-ribbon unit, it can also be effected by gravity.

The actuating element may for example be formed by a slide arranged to be movable between a pressure position and a released position on the ribbon guide device, which slide in its pressure position presses the feed roller against the inking roller by means of a spring element attached to it and can be locked in this position. By means of the spring element a contact is assured between the inking roller and the feed roller over the whole area available for the unit. The locking of the slide can be done by simple locking means. In order to be able to recognize the position of the feed roller from the outside, markings are preferably provided on the ribbon guide device and/or the slide.

Since in this way according to the invention the inking unit can be turned on and off, it is possible to start using it only when a reinking of the ink ribbon is actually needed. Thereby the service life of an ink ribbon is considerably lengthened compared with conventional ink-ribbon units, for the same length of ribbon, and at the same time a constant printing quality is achieved.

BRIEF DESCRIPTION OF THE DRAWING

Further features and advantages of the invention are also seen from the following description, which in connection with the attached drawing explains the invention on the basis of an embodiment example. In these.

DETAILED DESCRIPTION OF SPECIFIC EMBODIMENT

Figure 1:
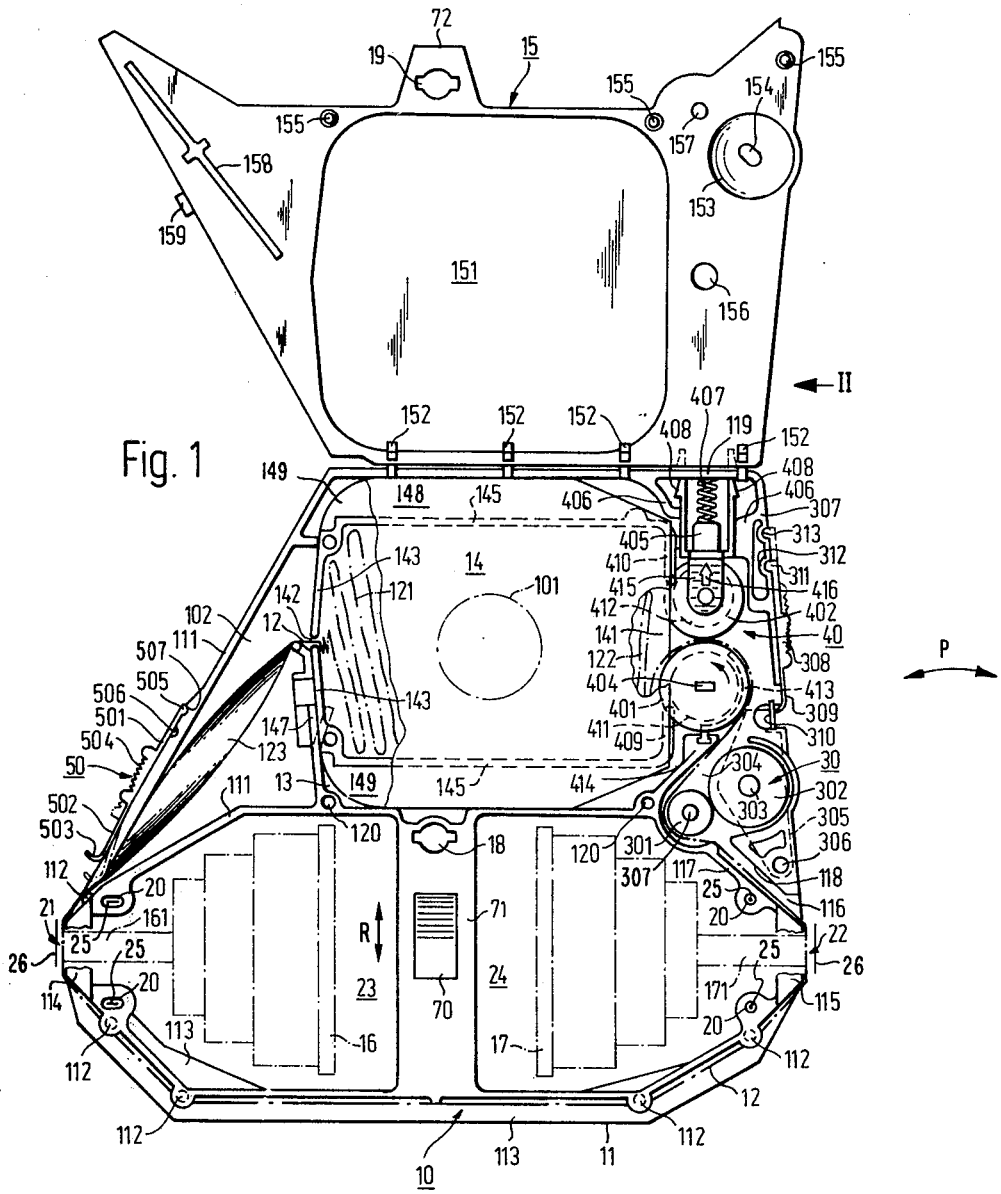
FIG. 1 shows a top plan view of the ink-ribbon unit according to the invention with an inserted ink-ribbon magazine and opened hinged cover according to the viewing direction I in FIG. 2.

In FIG. 1 is represented an ink-ribbon unit 10, which essentially embraces a ribbon guide device 11 for guiding an ink-ribbon 12, a recess 13 for an ink-ribbon magazine 14 and a hinged cover 15. The whole ink-ribbon unit 10 is represented in FIG. 1 in the opened state in a top plan view, i.e., the hinged cover 15 is swung open so that the ink-ribbon magazine 14 inserted in the recess 13 as well as the ink ribbon 12 running through the ribbon guide device 11 can be recognized. Besides this, two print heads 16 and 17 are represented, which signify that the whole ink-ribbon unit 10 is inserted in a printing unit in such a way that its frame-like ribbon guide device 11 surrounds both print heads 16 and 17. This construction of the ink-ribbon unit 10 is only an embodiment example, and likewise a construction is possible such that the ribbon guide device 11 surrounds only a single printing head (not shown) when the ink-ribbon unit 10 is to be inserted into printing units (not shown) with only one printing head.

The ink-ribbon unit 10 shown in FIG. 1 may either be built integrally into a printing unit or be constructed as an interchangable magazine. In particular, for use as a magazine, central openings 18 and 19 are advantageous in the ribbon guide device 11 and the hinged cover 15, which make it possible to anchor the ink-ribbon unit 10 in a printing unit on an anchoring pin 605 which, in a manner yet to be described, makes possible a locking of the magazine cover 15 at the same time. Moreover, for use as an interchangable magazine, openings 20 are provided in the body of the ribbon guide device 11 in which pins 25 anchored in the printing unit, are introduced in inserting the ink-ribbon unit 10, so that a reliable alignment of the ink ribbon direction relative to one or more print heads 16 or 17 is insured. Some of the openings 20 may be constructed as slots, as is represented for the two left openings in FIG. 1, in order to compensate for possible dimensional tolerances of different ink-ribbon units 10.

The ink-ribbon magazine 14 has an essentially square horizontal projection and may be constructed as an injection molded plastic part. The ink-ribbon magazine 14 has an inlet opening 141 and an outlet opening 142, which have about the width of a slit. The inlet opening 141, however, is constructed relatively wide, so that the ink ribbon 12 can be slipped in through the inlet opening 141 with the formation of loops 122 in the ink-ribbon magazine 14. In the ink-ribbon magazine 14 the ink ribbon 12 lies in the form of adjacent loops, as shown at 121, so that a very large amount of ink ribbon 12 can be stored in the magazine 14 in a known manner.

Figure 4:
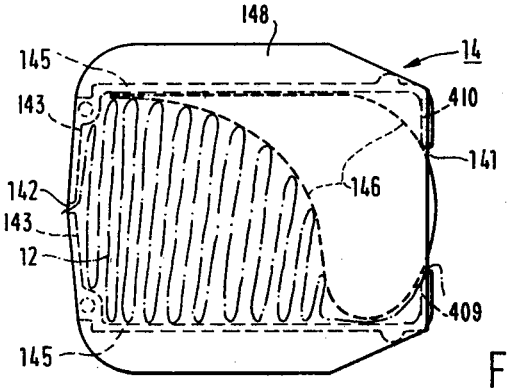
FIG. 4 shows a top plan view of an ink-ribbon magazine alone.

The ink-ribbon magazine 14, with the endless ink ribbon 12 stored in it or outside the inlet opening 141 and connected with the outlet opening 142, can be removed from the ink-ribbon unit 10, i.e., it is possible to renew the ink ribbon 12 merely by replacing the relatively simply constructed ink-ribbon magazine 14. As is recognized in FIGS. 1 and 4, the side walls 145 of the ink-ribbon magazine 14 are shifted inward with respect to the base 149 and the cover 148 of the ink-ribbon magazine 14, and so the actual space for receiving ink-ribbon loops 121 is essentially rectangular. This makes possible a good support of the ink-ribbon loops 121 in the ink-ribbon magazine 14 and a uniform withdrawal of the ink ribbon 12 from the outlet opening 142, since the ink-ribbon loops 121 present in an irregular distribution in the ink-ribbon magazine 14 are a fairly short distance from the outlet opening 142 as a whole. This insures a uniform pushing conveying of the ink ribbon 12 through the ink-ribbon magazine 14. Ease of withdrawal of the ink ribbon 12 even from a region immediately adjacent to the outlet opening 142 is favored by the fact that in this region the magazine's walls 143 have a shape turning obliquely to the outlet opening 142 in the movement direction of the ink ribbon 12. The side walls 145 displaced inward also create an intermediate space between the base 149 and cover 148 of the ink-ribbon magazine 14, which when the ink-ribbon magazine 14 is stored outside the ink-ribbon unit 10, can be used to accommodate the part of the ink ribbon 12 located outside the ink ribbon magazine 14.

In order to facilitate the removal of the ink-ribbon magazine 14 from the ink-ribbon unit 10, there is an opening 101 provided in its bottom (represented in a dot-dash line) which makes it possible to eject the ink-ribbon magazine 14 upward by finger pressure. Since the inlet opening 141 of the ink-ribbon magazine 14 must be relatively large, it is advantageous to close off this inlet opening 141 by a special closure when the ink-ribbon magazine 14 is stored outside the ink-ribbon unit 10. This may, for example, be formed by an elastic strip 146, made of plastic for example, which may be introduced by both its ends into the ink-ribbon magazine 14 through the inlet opening 141 in the manner represented in FIG. 4 and lies in front of the inlet opening 141 with the formation of the loop which can be seen in FIG. 4. In this way any drying out or smudging of the ink ribbon 12 during the storage of the ink-ribbon magazine 14 is avoided. The strip 146 is pulled out before the ink-ribbon magazine 14 is inserted in the ink-ribbon unit 10. In place of the strip 146, an inserting slide (not shown) may also be provided, as was described in connection with the ink-ribbon magazine according to U.S. patent application Ser. No. 894,591 filed Apr. 7, 1978 by Haftmann et al, now U.S. Pat. No. 4,213,715 issued July 22, 1980.

In its inserted position the ink-ribbon magazine 14 is pretensioned in the direction of the drive by a spring element 147. The spring element 147 may be made integral with the frame construction of the ribbon guide device 11, for example by fabricating the latter as an injection molded part. If the ink-ribbon magazine 14 does not happen to be in the ink-ribbon unit 10, the spring element 147 assumes the position drawn in the broken line. When the ink-ribbon magazine 14 is inserted, the spring element 147 is bowed outward, whereby it then forces the ink-ribbon magazine 14 in the direction of the drive by reason of its elastic restoring force.

The ink ribbon 12 after passing through the ink-ribbon magazine 14 is passed out of the outlet opening 142 and then goes into a chamber 102 enclosed in a somewhat triangular shape by walls 111 of the ribbon guide device 11, in which it is turned into the shape of a Mobius strip 123. After this it is guided over a polygonal guide path, which in the embodiment example represented embraces two printing regions 21 and 22, in which the printing elements 161 and 171 of the respective print heads 16 and 17 can act on a recording tape 26 by way of the ink ribbon 12. The guiding of the ink ribbon 12 through the two printing regions 21 and 22 is done by means of the ribbon guide device 11 which, to achieve a polygonal guide path and therewith the smallest possible number of points of friction on the corners of this guide path, has guide pins 112 at the corners of this guide path around which the ink ribbon 12 is guided on their outsice. The ink ribbon 12 here has its bottom edge on the base 113 of the ribbon guide device 11, which base 113 has the effect of making the frame construction of the ribbon guide 11, formed by a vertical wall, more rigid. The base 113 is interrupted at 23 and 24 in order to make possible the insertion of the ink-ribbon unit between the print heads 16 and 17.

Instead of stationary guide pins 112, guide rollers can also be provided, in which way the ribbon friction is reduced still further. Suitable constructions are obvious to one skilled in the art.

At the printing regions 21 and 22 the walls of the ribbon guide device 11 are interrupted to permit the action of the printing elements 161 and 171 on a recording tape 26. Here the ink ribbon 12 is likewise guided past on guide pins 112 which are provided between the base 113 and the two top surfaces 114 and 115. These, together with the base 113 and the walls of the ribbon guide device 11, form a stable guide construction for the ink ribbon 12 at the printing regions 21 and 22, so that here in particular an always accurately aligned guiding of the ink ribbon 12 is assured.

After it has passed through the printing region 22, the ink ribbon 12 is conveyed through a channel 116 which is formed between two vertical walls 117 and 118 of an inking device designated as a whole as 30, which contains an inking roller 301 and a feed roller 302 serving as an ink storage element. The inking roller 301 has the ink ribbon 12 wound around part of its periphery and is driven by the latter. In the position represented in FIG. 1 the feed roller 302 saturated with a printing ink rolls on the inking roller 301 with the latter's motion and thereby transfers printing ink (not shown) to the inking roller 301, which the latter in turn passes on to the ink ribbon 12. In this way the service life of the ink ribbon 12 can be lengthened.

According to the invention the feed roller 302 with its shaft 303 is mounted on a rocker 305 which in turn is mounted so as to be pivotable on the frame construction of the ribbon guide device 11, pivotable around an axis of rotation 306 running parallel to the shaft 303 of the feed roller 302. By means of the rocker 305, the feed roller 302 can be swung in the direction of the double arrow P (FIG. 1) between a first represented position in which the inking roller 301 and the feed roller 302 touch each other, and a noncontacting second position. For this a minimal distance between the two rollers 301 and 302 is sufficient to prevent any transfer of ink from the feed roller 302 to the inking roller 301, when the inking device 30 is intended to remain turned off.

The adjusting of the rocker 305 and therewith of the feed roller 302 is done with the aid of a slide 308 which is mounted movably on one wall 307 of the ribbon guide device 11. The slide 308 on its end turned toward the feed roller 302 carries a spring blade 309, which, in the position of the slide 308 as represented in FIG. 1, comes to lie against a projection 310 of the rocker 305, which stands up from the rocker 305 vertically to the plane of FIG. 1. Thereby the rocker 305 and with it the feed roller 302 are swung in the direction toward the inking roller 301. On its end turned toward the spring blade 309, the slide 308 has a stop pin 311, which, in the pressure position of the slide 308 as represented by solid lines in FIG. 1, engages in a recess 312 in the wall 307 and thus locks the slide 308 in the pressure position. The inking device 30 is turned on therewith. But if the slide 308 is moved into the released position represented by broken lines in FIG. 1, whereby the stop pin 311 is engaged in the recess 313, then the spring blade 309 is released from the projection 310 of the rocker 305, and so the latter, under the action of gravity (depending on the mounting position of the ink-ribbon unit 10), or by spring means which are not represented, moves toward the right in FIG. 1. Therewith the feed roller 302 is released from the inking roller 301, so that the latter does not become further supplied with ink (not shown) and as a consequence the ink ribbon 12 is not reinked. In order to make the released position and the pressure position of the slide 308 recognizable from the outside, markings 314 may be provided on the cover 15 of the ink-ribbon unit 10.

It is possible, by means of an inking device 30 which can be switched on and off, to make the ink ribbon 12 be reinked only when it is already so depleted that a reinking is actually necessary. This avoids the disadvantage occurring in the conventional ink-ribbon units, that additional ink was applied by the inking device to the ribbon which was still fresh, which at the start of the service life of the ink ribbon led to a super saturation, while later any reinking of the ink ribbon over a sufficiently long period was no longer possible for lack of ink. With the inking device 30 according to the invention, however, a considerably longer service life of the ink ribbon 12 can be attained. As is seen, the inking device 30 is arranged near the inlet opening 141 of the ink-ribbon magazine 14, so that after the renewed inking of the ink ribbon 12, there is a relatively long residence time in the ink-ribbon magazine 14 available for the uniform distribution of the printing ink in the ink ribbon 12.

The feed roller 302 may be arranged to be interchangeable on its shaft 303, so that it can be replaced independently of an interchanging of the ink ribbon 12 or at the same time as this.

The base 113 of the ribbon guide device 11 can be constructed in the form of a basin at 304, i.e., in the region of the feed roller 302, so that any printing ink which may issue from the feed roller 302 is collected in this section, and any escape of printing ink into a printing unit into which the ink-ribbon unit 10 is inserted is prevented.

After leaving the inking device 30 the ink ribbon 12 reaches the region of a drive unit 40, which essentially has a driving roller 401 which can rotate in the direction of the arrow and a back-up roller 402 interacting with this. The ink ribbon 12 is guided from the inking roller 301 of the inking device 30 between the driving roller 401 and the back-up roller 402. The driving roller 401 has a central recess, not visible, which deviates from the circular shape, in which a driving pin catches after the insertion of the ink-ribbon unit 10 into a printing unit and the pin rotates the driving roller 401 in the direction of the arrow. Through the action of the driving roller 401 and the back-up roller 402, the ink ribbon 12 is pushed through the inlet opening 141 into the ink-ribbon magazine 14, in which way loops 122 of ink ribbon 12 already lying adjacent to one another are formed directly behind the two rollers 401 and 402.

To prevent the ink-ribbon loops 122 from being dragged along by the driving roller 401 or the back-up roller 402 and becoming wound around these two rollers 401 and 402, deflectors 409, 410 are arranged on the ink-ribbon magazine 14 which engage respectively in a slot 411 and 412 constructed on the periphery of the driving roller 401 and of the back-up roller 402. To prevent the ink ribbon 12 from being drawn into the slot 411 during its movement on the driving roller 401, the slot 411 at this peripheral region of the driving roller 401 is furnished with still another deflector 413, which is anchored in releasable form on one part 414 of the frame of the ribbon guide device 11 and the contours of which are denoted by broken lines.

The back-up roller 402 is retained on a supporting part 405 which is mounted movably in a guide 406. A spring 407 which is supported on a wall 119 of the ink ribbon unit 10 forces the supporting part 405 and therewith the back-up roller 402 against the ink ribbon 12 and the driving roller 401. The supporting part 405 is provided with two side arms with catch elements 408 on them which can be passed through openings in the wall 119, so that when the supporting part 405 is pushed upward with reference to the representation in FIG. 1 and out of the ink-ribbon unit 10, it catches on the outside of the wall 119. This position of the catch element 408 is represented in broken lines in FIG. 1. The back-up roller 402 is then spaced apart from the driving roller 401, whereby it is possible to change the ink ribbon 12 with its ink-ribbon magazine 14.

The supporting part 405, so that it may more easily be pushed to its upper side, is provided with a grooving 415 on its upper side; this may also show an arrow symbol 416 in order to make the proper servicing easier for the servicing person in changing the ink ribbon 12.

The ribbon guide device 11 is provided with a brake 50 before the printing region 21, comprising a slide 501 and a spring element 502, which is bent at its front end 503. The slide 501 has a knurled surface 504 so that it can be pushed manually on the left wall 111 of the ribbon guide device 11 in FIG. 1, on which it is guided in a suitable slot. The brake device 50 is shown in solid lines in FIG. 1 in its open state, in which its front end 503 does not act on the ink ribbon 12. The slide 501 has on its back end a catch element 505 with which it catches in a corresponding rear recess 507 in the wall 111. If it is pushed manually into the position represented in broken lines, then the catch element 505 catches in another recess 506 which is so arranged that, in the braking position then reached, the front end 503 presses the ink ribbon 12 against the guide pin 112 assigned for this and thus a braking action is exerted on the ink ribbon 12. Through the action of the driving arrangement 40 and the braking device 50, the ink ribbon 12 is kept under tension over the whole path between the two printing regions 21 and 22. On the other hand, in the space 102 the Mobius strip 123 is formed without difficulty.

The hinged cover 15 is provided with a recess 151 which is so constructed that a part of the ink-ribbon magazine 14 projecting upward out of the ink-ribbon unit 10 can be reliably locked in and retained when the hinged cover 15 is brought into the closed position. The hinged cover 15 is pivoted on the ink-ribbon unit 10 with hinge elements 152. These hinge elements 152 may be the so-called open hinges such that it is possible to remove the hinged cover 15 from the other parts of the ink-ribbon unit 10. The open hinges may consist of a plastic which is softer than tho other parts of the ink-ribbon unit 10, so that it is possible to release the hinged cover 15 in the manner of a snap action.

The hinged cover 15 also has in its inner surface a basin-shaped recess 153 at a position corresponding to the position of the feed roller 302 of the inking device 30. The purpose of the basin-shaped recess 153 corresponds to that of the basin-shaped recess 304 already described in the base 113 of the ribbon guide device 11.

The hinged cover 15 is also provided with a guide opening 154 which serves for guiding the feed roller 302 or its shaft 303. Other pins 155 go into their assigned guide openings 120 in the ribbon guide device 11 when the hinged cover 15 is clapped shut, which insures an always reliable alignment of the hinged cover 15 with respect to the other part of the ink-ribbon unit 10.

The hinged cover 15 also has an opening 156 which is assigned to the driving roller 401 and also makes possible the manual rotation of this roller 401 on a pin 404 from above. Another bored hole 157 locks the shaft 307 of the inking roller 301 in position when the cover 15 is closed.

The hinged cover 15 also has, in the section assigned to Mobius strip 123, a guide bar 158 which is approximately in the shape of a cross and facilitates the formation of Mobius strips 123 in the shape 102 of the ribbon guide device 11.

An outer projection 159 on the hinged cover 15 causes the braking device 50 to be able to be brought into the opening position represented in solid lines in FIG. 1 only when the hinged cover 15 is opened. On the other hand, this can be closed only when the braking device 50 has first been brought into the braking position as is represented in broken lines in FIG. 1.

In the closed state of the ink-ribbon unit 10, regardless of whether the latter is built into a printing unit or not, the hinged cover 15 can be locked by a slide 70 which is arranged on a partition 71 of the frame construction of the ribbon guide device 11 so as to be moveable in the direction of the double arrow R, and with its upper end as seen in FIG. 1 can catch on an edge 72 near the perforation 19 of the hinged cover 15 when the hinged cover 15 is closed.

Figure 2:
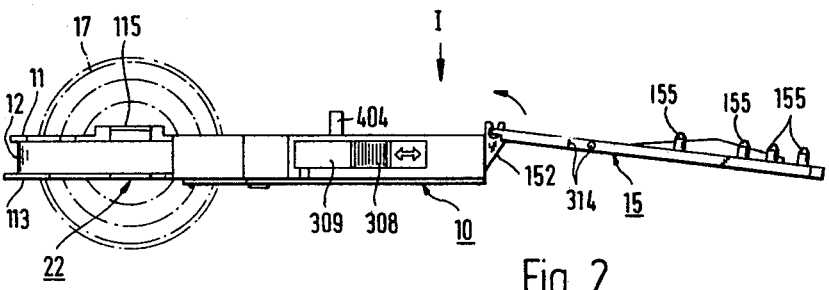
FIG. 2 shows a side elevation of the ink-ribbon unit shown in FIG. 1 with opened hinged cover according to the viewing direction II in FIG. 1.

FIG. 2 represents the ink-ribbon unit 10 in its side elevation, which corresponds to a direction of observation from the right in relation to the representation in FIG. 1. The hinged cover 15 is shown in the opened position, and moreover an open hinge 152 may be seen.

FIG. 2 indicates that the hinged cover 15 is swung in the direction of the arrow to close the ink-ribbon unit 10.

FIG. 2 also shows that the ink-ribbon unit 10 is assigned to one print head 17, and this print head 17 is represented in a dot-dash line as in the representation in FIG. 1.

FIG. 2 also shows in what way the covering area 115 on the ribbon guide device 11 forms a rigid guide construction for the ink ribbon 12 in the printing region 22. Therewith the ink ribbon 12 is continuously guided on the base 113 of the ribbon guide device 11.

Figure 3:
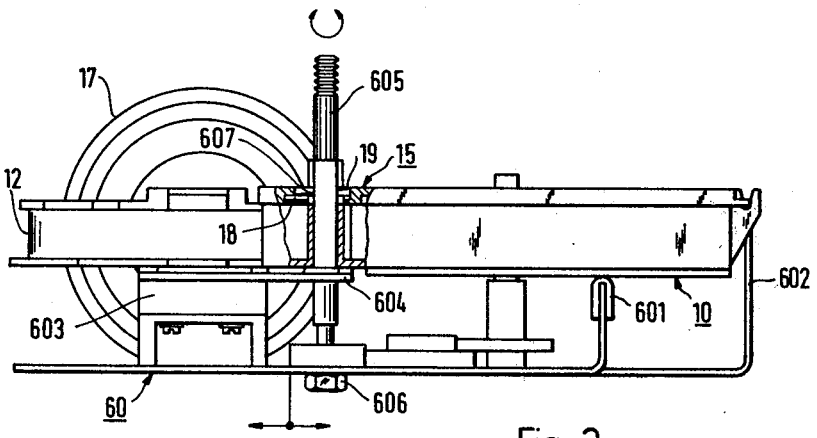
FIG. 3 shows a side view of the ink-ribbon unit in the closed state and inserted in a printing unit.

FIG. 3 shows a representation of the ink-ribbon unit 10 similar to FIG. 2, but in the closed state after its insertion into a printing unit or a print head carrier 60. The print head carrier 60 for the print head 17 is provided with supports 601 and 602 on which the right part of the ink-ribbon unit 10 rests. Onto a mounting 603 for the print head 17 is fastened a plate 604 which has a retaining pin 605, at a position corresponding to the central openings 18 and 19 (FIG. 1), which can be joined to the print head carrier 60 proper by a bolt 606. In the region of the openings 18 and 19 the ink-ribbon unit 10 is represented in a section in FIG. 3, and it may be seen that the retaining pin 605 may be provided with a central fastener 607 through which the hinged cover 15 can be held on the ink-ribbon unit 10 in the closed position and the ink-ribbon unit 10 in turn is held fast onto the print head carrier 60. The locking elements of the fastener 607 which are required for this are not represented in detail in FIG. 3; for this, various possibilities will be obvious to one skilled in the art, e.g. wedge-shaped elements which can be locked by rotating the retaining pin 605 on elements assigned to it in the ink-ribbon unit 10.

The support 602 may be so constructed that it acts on the catch elements 408 when these are in the position shown in broken lines in FIG. 1. In this way it is insured that the drive for the ink-ribbon unit 10 is inserted in a printing unit (not shown).

Instead of the pins 155, recesses may also be provided in the hinged cover 15 into which extended shafts of the rollers 302 and 402 may be introduced when the hinged cover 15 is closed.

The embodiments of the invention in which an exclusive property or privilege is claimed are defined as follows:

1. A selectively engageable ribbon re-inking device for an ink ribbon cartridge having a storage chamber provided with an inlet and an outlet opening for an endless ink ribbon and having a ribbon guide device connected with the storage chamber for guiding the endless ink ribbon from the outlet opening through at least one printing region to the inlet opening, comprising:

an inking roller mounted for rotation about a stationary axis on the cartridge and having the periphery thereof contacting the endless ink ribbon;

a feed roller mounted on a rocker adjacent said inking roller for rotation about a stationary axis and storing a supply of ink, said feed roller being selectively engageable with said inking roller and being arranged to be replaceable;

said rocker being shiftably mounted on said cartridge and being movable between a first position in which said feed roller engages said inking roller for transferring a portion of said ink supply from said feed roller to said inking roller, and a second position in which the feed roller is disengaged from said inking roller;

a manually shiftable activating element mounted exteriorly of said cartridge for engagement with said rocker, said activating element being movable between an activated position and a released position for moving said rocker from said second position thereof to said first position thereof, said activating element being lockable in said activated position; and a spring element carried by said activating element for urging said rocker toward said activating position thereof.

2. A selectively engageable ribbon re-inking device for an ink ribbon cartridge having a storage chamber provided with an inlet and an outlet opening for an endless ink ribbon and having a ribbon guide device connected with the storage chamber for guiding the endless ink ribbon from the outlet opening through at least one printing region to the inlet opening, the re-inking device being arranged in the continuous path of the ink ribbon and comprising:

an inking roller for winding the ink ribbon around a portion of the periphery of said inking roller;

an ink storage element formed by a feed roller for storing ink and being arranged to be replaceable;

the inking roller being mounted pivotally around a stationary axis;

the feed roller being mounted pivotally around a stationary axis on a rocker which is mounted pivotally around a pivot axis substantially parallel to the axis of the said feed roller and said inking roller for adjustment relative to each other between a roller engaging position, in which the feed roller rolls on the inking roller and a non-contacting position in which the feed roller is disengaged from said inking roller;

the feed roller being biased into the non-contacting position; and an actuating element formed by a slide being arranged to be movable selectively between a pressure position and a released position, which slide in said pressure position presses the feed roller against the ink roller by means of a spring element carried by said actuating element, said actuating element being lockable in said pressure position.

3. A selectively engageable ribbon re-inking device as described in claims 1 or 2 wherein said feed roller is mounted on said rocker to be biased in said non-contacting position by gravity acting on the feed roller and the rocker.

* * * * *